United States Patent [19]

Thaler

[11] 4,302,645

[45] Nov. 24, 1981

[54] GAS-BLAST SWITCH

[75] Inventor: Richard Thaler, Unterentfelden, Switzerland

[73] Assignee: Sprecher & Schuh AG, Aarau, Switzerland

[21] Appl. No.: 962,218

[22] Filed: Nov. 20, 1978

[30] Foreign Application Priority Data

Dec. 12, 1977 [CH] Switzerland ..... 15198/77

[51] Int. Cl.[3] ..... H01H 33/70

[52] U.S. Cl. ..... 200/148 A

[58] Field of Search ..... 200/148 A

[56] References Cited

U.S. PATENT DOCUMENTS

| | | | |
|---|---|---|---|
| 2,866,045 | 12/1958 | Leeds | 200/148 A |
| 3,941,962 | 3/1976 | Thaler | 200/148 A |
| 4,070,558 | 1/1978 | Stewart et al. | 200/148 A |
| 4,160,888 | 7/1979 | Natsui et al. | 200/148 A |

*Primary Examiner*—Robert S. Macon

*Attorney, Agent, or Firm*—Werner W. Kleeman

[57] ABSTRACT

A gas-blast switch having a housing composed of a hollow insulator body. Within such housing there are arranged a set of fixed contacts and a set of movable contacts surrounded by a blast chamber as well as a blast nozzle operatively associated with the set of movable contacts. The blast nozzle is connected with a pump device. This pump device comprises a pump cylinder movable in conjunction with the movable contact set. The pump cylinder coacts with a stationary pump piston. In the pump chamber or compartment defined by the pump cylinder there merges a nonreturn or check valve which opens towards such pump chamber. By means of such nonreturn valve there is sucked-up pressurized extinguishing gas during the course of the cut-on switching-on stroke of the gas-blast switch. The pump chamber is connected by means of this nonreturn valve with a supply compartment which, in turn, communicates by means of labyrinth-like extending flow paths with the blast chamber. The supply compartment is advantageously formed in a hollow body, for instance of cylindrical shape, the end face of which is structured as the pump piston. The access or communication between the blast chamber and the supply compartment is spaced as far as possible from the nonreturn valve which leads to the pump chamber.

7 Claims, 2 Drawing Figures

GAS-BLAST SWITCH

BACKGROUND OF THE INVENTION

The present invention relates to a new and improved construction of a gas-blast switch.

The gas-blast switch of the invention is of the type comprising a gas tight housing incorporating a hollow insulator. Within the housing there is arranged a set of fixed contacts and a set of movable contacts surrounded by a blast chamber as well as a blast nozzle operatively associated with the set of movable contacts and connected with a pump device. This pump device embodies a pump cylinder surrounding a pump chamber and movable in conjunction with the movable set of contacts. The pump cylinder is displaceably mounted upon a stationary piston. A nonreturn or check valve merging with the pump chamber and opening towards the pump chamber sucks-up pressurized extinguishing gas into the pump chamber during the course of the cut-on stroke of the gas-blast switch.

Such switches are designed as so-called "lifetank" switches, wherein the housing carrying the electrical connections of the switch and predominantly composed of the hollow insulator is attached to a support insulator. The entire requirement of extinguishing or quenching gas is withdrawn from the contents of the switch housing itself, including the contents of a possibly provided support tube and a drive housing. In contrast hereto, in the case of the so-called "deadtank" switches there is provided a grounded metal housing. The requirement of extinguishing or quenching gas, in this case, is furnished by the contents of the relatively voluminous metal housing. Here the electrical connections are conducted out of the metal housing through electrical passages.

The switches of the initially mentioned type, thus, in comparison to the so-called "deadtank" switches, contain an appreciably smaller quantity of extinguishing or quenching gas, for instance $SF_6$.

The blowing of the arc during the course of the cut-off stroke causes in the blast chamber or compartment—in other words in a spatially limited region—an appreciable pressure and temperature increase. While the pressure increase tends to propagate to all parts of the switch practically without any delay, the temperature increase initially is limited to the region of the blast chamber and temperature compensation by means of the gas at the more remote locations, such as for instance at the drive housing, only occurs gradually. If there is considered that the quantity of gas in the switch is constant, it will be apparent that at that location where there prevail increased gas pressure and also an appreciable temperature increase governed by the arc, there is present lower gas density, than at that location where initially there has been effective the pressure increase, and possibly a low temperature increase due to the compression.

Now if, as is the rule with a heretofore known switch of the previously mentioned type, for instance as taught in French Pat. No. 2,291,601, following a cut-off or switch-off operation, caused by a short-circuit condition, there is again automatically triggered a cut-on or switching-in operation after several tenths of a second, then in the pump chamber or compartment gas will be sucked-up from that region where the density of the gas has decreased owing to the previously mentioned cut-off operation. Now if following the automatice cut-on or switching-in operation the short-circuit has not been eliminated and there directly follows a second cut-off operation, approximately 0.3 seconds after the first cut-off or switching-off operation, then there is only available in the pump chamber gas having a low density for blowing the arc which has formed during the course of this cut-off operation. Gas of lower density however means lower dielectric strength and reduced cut-off efficiency, and equally—since during the second cut-off operation there has not yet occured any appreciable cooling of the gas—reduced cooling capability and at the same time approaching the ionization temperature of the extinguishing gas. Thus, with a "lifetank" switch of the previously mentioned type there must be reckoned with a quite appreciable reduction of the cut-off efficiency when there are undertaken brief successive cut-off or switching-off operations.

SUMMARY OF THE INVENTION

Hence, it is a primary object of the present invention to provide a new and improved construction of a switch of the previously mentioned type wherein there are extensively avoided the above-discussed drawbacks and limitations.

Now this object and others which will become more readily apparent as the description proceeds, can be attained with a switch of the previously mentioned type, according to the teachings of the invention, in that the pump chamber is connected by means of the check or nonreturn valve with a supply compartment or chamber. This supply compartment communicates by means of at least one labyrinth-like extending flow path with the blast chamber.

With the proposed switch, during the cut-on stroke there is thus sucked-up extinguishing or quenching gas from the supply compartment, which, in turn, only communicates by means of a labyrinth-like extending flow path with the blast chamber. Therefore, if the gas in the blast chamber, during the cut-off operation, experiences a sudden increase in pressure and temperature, then the pressure surge so-to-speak simultaneously propagates into the supply compartment. Furthermore, any possible increase of the temperature internally of the supply compartment, in any case, will be delayed in time at least for such length of time until—following a renewed switching-in operation—there has been accomplished a possible second cut-off or switching-off operation. Hence, this gas in the supply compartment essentially only experiences a compression without any appreciable heating-up, i.e., in fact an increase of its density. Thus, there is available, during a second cut-off operation following the first cut-off, extinguishing or quenching gas for blowing the arc which, in fact, has a greater density and only an inappreciable higher temperature than the extinguishing gas ejected out of the pump chamber during the first cut-off operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
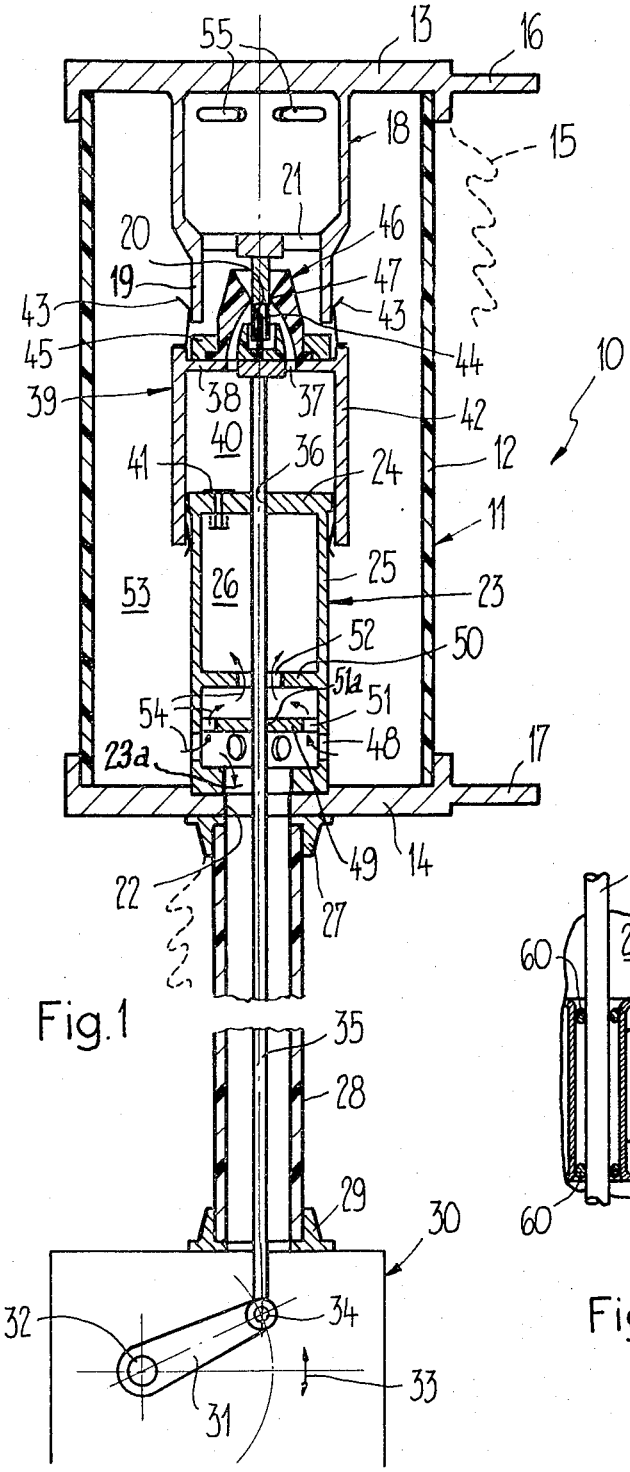
FIG. 1 is a schematic longitudinal sectional view through a gas-blast switch constructed according to the invention, the parts not being shown in scale

Describing now the drawings, it is to be understood that throughout the various Figures functionally equivalent parts have been conveniently designated with the same reference characters. The illustrated exemplary embodiment of gas-blast switch 10 as shown in FIG. 1 will be seen to comprise a housing 11 which, in turn, is constructed of a substantially tubular-shaped insulating body or body member 12. Both opposed ends of the insulating body 12 are sealingly closed by electrically conductive closure flanges 13 or 14 or equivalent structure. The insulating body 12, as indicated by broken lines 15, also can be formed by a porcelain insulator.

The electrical connections or terminals 16 and 17 of the switch 10 are connected with the closure flanges 13 and 14, as has only been schematically indicated. Connected with the closure flange 13 is a fixed contact body 18 which protrudes into the interior or internal compartment of the housing 11. This fixed contact body 18, in turn, comprises a contact tube 19 serving as a power contact and a contact bushing or sleeve 20 serving as a burn-off contact and arranged substantially coaxially within the contact tube 19. The contact bushing 20 is attached by means of spoke-like struts 21 at the inside or inner wall of the contact tube 19.

Attached to the closure flange 14, which is centrally provided with a throughpass opening or throughpassage 22, is a substantially cylindrical hollow body 23 formed of electrically conductive material. The end of the hollow body 23 which is remote from the flange 14 is sealed by an end wall structured as a piston 24. This piston 24 and the jacket or outer surface 25 of the hollow body 23 therefore enclose a supply compartment or chamber 26, the function of which will be described in greater detail hereinafter.

Sealingly connected with the outside of the flange 14, by means of a connection collar or sleeve 27, is an electrically insulating support tube or pipe 28 which is in alignment with the throughpass opening 22. The lower end of the support tube 28 is sealingly connected by means of a connection collar or sleeve 29 with a merely schematically indicated drive housing 30. Within this drive housing 30 there is arranged, for instance, a drive crank 31 which can be rocked in the direction of the double-headed arrow 33 about its shaft 32 by any suitable and therefore not further shown drive means. At the free end of the crank 31 there is articulated at location 34 a thrust and traction rod 35 formed of electrically insulating material. This thrust and traction rod 35 extends coaxially through the support tube 28, the opening 22, through the hollow body 23 which is open by means of a hole **23*a* at the region of the opening 22 and through the opening 51*a* and passage 52 of transverse walls 51 and 52, respectively and through a bore 36 provided in the piston 24. At the upper end of the rod 35 there is attached the base or floor 38 of a pump cylinder 39. This pump cylinder floor 38 is provided with the throughpassages or passageways 37. The inner space or chamber of the pump cylinder 39 between the piston 24 and the cylinder floor 38 thus constitutes a pump chamber or compartment 40. This pump chamber 40 is only connected with the supply compartment or chamber 26 by means of a suitable valve, such as a nonreturn or suction valve 41 which opens towards the pump chamber 40 and is arranged in the piston 24**.

At the outer shell or jacket 42 of the pump cylinder 39, and which jacket protrudes past the cylinder floor or base 38, there is attached a rim of resilient contact fingers 43, which, with the illustrated cut-on or switching-in position, engage at the outside of the contact tube 19. Further, there is secured at the floor 38, at the central region of the side confronting the piston 24, a contact pin 44 serving as a burn-off contact and which engages into the bushing 20. The throughpassages or passageways 37 in the floor or base 38 open into a blast nozzle 46 formed of electrically insulating material and attached by means of an attachment ring 45 at the outside of the floor or base 38. The narrowest location or throat 47 of the blast nozzle 46, in the illustrated cut-on position, so-to-speak sealingly encloses the outer side of the bushing or sleeve 20.

At the end region of the hollow body 23, remote from the piston 24, there are provided at its outer surface or jacket 25 throughpass openings 48. These throughpass openings or ports 48 do not open directly into the supply chamber or compartment 26. Quite to the contrary there are arranged between the throughpass openings 48 and the supply compartment 26 a number of the aforementioned mutually parallel extending transverse walls 49, 50 in the hollow body 23, in the illustrated exemplary embodiment there are shown two such transverse walls. These transverse walls 49, 50 are alternately provided at the region of their periphery and at the region of their center, respectively with the passages or passageways 51 and 52 respectively, or equivalent structure,—passage 52 also forming an opening for the passage of the rod 35 as previously explained—so that gas from the blast chamber 53 located externally of the pump cylinder 39 and the hollow body 23 can only flow into the supply compartment 26 by moving through labyrinth-like flow paths indicated by the arrows 54.

Now if there is accomplished a cut-off or switching-off operation, then by means of the crank 31 and via the rod 35 the pump cylinder 39 together with the thereat attached contact fingers 43 and the contact pin 44 are drawn downwardly. Consequently, initially the contact fingers 43 come out of engagement with the contact tube 19. The gas in the pump chamber 40 experiences a pre-compression, since the blast nozzle 46 still is closed by the bushing part or sleeve 20. As soon as the contact pin 44 leaves the bore in the bushing part 20 there is ignited an arc which is blown by the extinguishing or quenching gas flowing out under pressure from the pump chamber 40 through the now free blast nozzle 46. This gas is forcefully heated and thus experiences a pressure increase. It expands past the struts 21 in the interior of the contact body 18 and from that location flows via the slots 55 provided therein into the blast chamber 53. The pressure surge which is formed in such blast chamber or compartment 53 propagates through the throughpass openings 48 and from that location, on the one hand, into the support tube 28 and the therewith connected drive housing 30, and, on the other hand, also however through the throughpassages 51, 52 into the supply compartment 26. Consequently, the gas which is present thereat is compressed. The increased temperature of the gas which has departed out of the blast chamber 53, however is only transmitted in a modest degree and much more slowly to the gas present in the supply compartment 26 as well as to the gas present in the support tube 28 and in the drive housing 30.

Now if there occurs directly after this cut-off operation again a cut-in operation, then there is sucked-up out of the supply compartment 26 pre-compressed, relatively cool and noncontaminated extinguishing gas through the valve 41 into the pump chamber 40. Hence, in this pump chamber 40 there is available for any possibly directly following, renewed cut-off operation a gas quantity whose properties as concerns its dielectric strength and cooling capability at least corresponds to that of the gas employed for blowing the first or previous arcs, although in the meantime gas has collected in the blast chamber 53 which initially has less favourable properties for direct blowing of an arc.

Figure 2:
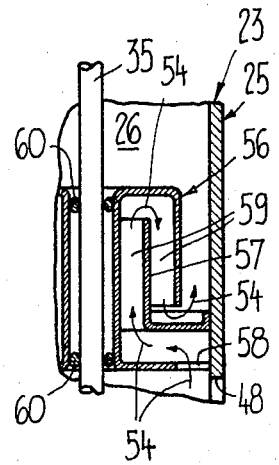
FIG. 2 is a longitudinal fragmentary sectional view through part of a variant embodiment of gas-blast switch.

With the embodiment shown in FIG. 2, there will be recognized the jacket or shell 25 of the hollow body 23 and the thrust and traction rod 35 which extends therethrough. Equally, there will be seen the throughpass openings 48 provided at the lower end region of the jacket 25.

Internally of the hollow body 23 there are attached two collar-like shaped baffle elements 56 and 57 engaging with play with one another. Starting from the throughpassages 58 provided at the peripheral region of the baffle element 56 these baffle elements 56, 57 leave free a meander-like extending jacket chamber or compartment 59 which so-to-speak is "upset" or "turned back" upon itself.

Through this jacket compartment 59 there can flow, in the direction of the arrows 54, gas into the supply compartment 226 and which arrives through the openings 48 from the blast chamber 53. Sealing rings 60 seal the baffle element 56 with respect to the rod 35.

The advantageous effects of the supply compartment 26 are particularly then discernible if its volume is greater, preferably 1.1 to 1.8 times greater, than the volume of the pump chamber 40 in the switching-in or cut-on position of the gas-blast switch. This is so because the pump chamber 40 can only suck-up a quantity of gas corresponding to its volume, and when this quantity is less than that in the supply chamber 26, there can in fact even be accepted a condition where gas of lesser density penetrates into the lower region of the supply compartment 26. Before this initially localized, limited density reduction spreads throughout the entire supply compartment 26 there has already been accomplished for quite some time the automatic cut-on stroke which follows a cut-off stroke.

While there are shown and described present preferred embodiments of the invention, it is to be distinctly understood that the invention is not limited thereto, but may be otherwise variously embodied and practiced within the scope of the following claims. Accordingly,

What I claim is:

1. A gas-blast switch comprising:

a gas tight housing incorporating a hollow insulator;

said housing defining a blast chamber therein;

a set of fixed contacts and a set of movable contacts arranged in said housing and surrounded by said blast chamber;

a pump device for extinguishing gas;

a blast nozzle arranged in said housing and operatively associated with said set of movable contacts;

said pump device comprising a pump cylinder enclosing a pump chamber;

said pump cylinder being movable in conjunction with the set of movable contacts;

said pump device further comprising a stationary pump piston upon which there is displaceably mounted said pump cylinder;

a non-return valve cooperating with the pump chamber and opening in the direction of the pump chamber;

pressurized extinguishing gas being sucked-up into the pump chamber by means of said non-return valve during the course of a cut-on stroke of the gas-blast switch;

a supply compartment distinct from said blast chamber and having two axially spaced opposite ends;

said non-return valve being mounted at one end of said supply compartment for connecting the latter with said pump chamber; and means disposed at the other end of said supply compartment defining at least one labyrinth-like extending flow-path communicating said supply compartment with said blast chamber.

2. The gas-blast switch as defined in claim 1, wherein:

said supply compartment is formed in a hollow body having an end face serving as the pump piston.

3. The gas-blast switch as defined in claim 2, wherein:

said hollow body possesses a substantially cylindrical configuration;

said hollow body having an end region remote from the pump piston and provided at its out surface with throughpassage openings leading to the blast chamber; and baffle means provided for said hollow body and serving to limit the labyrinth-like flow path.

4. The gas-blast switch as defined in claim 3, wherein:

said baffle means comprise essentially mutually parallel walls.

5. The gas-blast switch as defined in claim 4, wherein:

said walls extend essentially radially and alternately possess at the respective region of their periphery and the central region thereof throughpass means.

6. The gas-blast switch as defined in claim 1, wherein:

said supply compartment has a volume which is greater than the volume of the pump chamber in the cut-on position of the gas-blast switch.

7. The gas-blast switch as defined in claim 6, wherein:

the volume of the supply compartment amounts to approximately 1.1 to 1.8 times the volume of the pump chamber in the cut-on position.

* * * * *